US005216641A

United States Patent [19]

Hoel

[11] Patent Number: 5,216,641

[45] Date of Patent: Jun. 1, 1993

[54] INDICATING DEVICE

[76] Inventor: Richard K. Hoel, 8509 N. 7th Ave., Phoenix, Ariz. 85021

[21] Appl. No.: 817,444

[22] Filed: Jan. 6, 1992

[51] Int. Cl.[5] ..... G04B 47/00; G04F 8/00; A63B 69/36

[52] U.S. Cl. ..... 368/10; 368/107; 368/109; 368/223; 273/32 H

[58] Field of Search ..... 368/10, 15-21, 368/62, 76, 80, 82, 223-228; 273/32 H, 183 R

[56] References Cited

U.S. PATENT DOCUMENTS 4,388,000 6/1983 Hagihara ..... 368/72
4,752,919 6/1988 Clark ..... 368/223
4,779,247 10/1988 Uchida ..... 368/22
4,847,819 7/1989 Hong ..... 368/21
5,013,069 5/1991 Hardin ..... 283/48.1
5,094,451 3/1992 Glamack ..... 273/32 H

*Primary Examiner*—Vit W. Miska
*Attorney, Agent, or Firm*—Gregory J. Nelson

[57] ABSTRACT

An indicating device having an indicator and a face which depicts an activity path such as the representation of a golf course. The indicator and path move relative to one another at a prescribed rate. By referring to the device, the user can determine the proper prescribed location after an elapsed time. The device will assist golfers and others in maintaining a desired rate of progress. The device may have an auxiliary timer. The activity path may be arranged in a circular or linear fashion. In an alternate embodiment, the device has a digital display.

4 Claims, 3 Drawing Sheets

INDICATING DEVICE

The present invention relates to an indicating device and more particularly relates to a indicating device for activities such as golf to provide the user or participant an indication of prescribed progress along the course at the particular elapsed time so the participant has a reference to assist in completing the round in an established time period.

The game of golf has gained increasing popularity in recent years. As a result of this increased popularity, the utilization of golf courses has also increased substantially, particularly on weekends. Accordingly, it is a practice for most golf courses to establish starting times or "tee" times which are generally scheduled approximately eight or ten minutes apart. A group of golfers, usually a foursome, begins the golf game at an established tee time. Taking into consideration the various expected and unexpected occurrences that can occur during a round of golf, a round of golf should normally be played within a prescribed period of time, for most courses about four hours. Ideally if every golf group played at a consistent and prescribed rate, all groups would finish in prescribed time and interruptions and delays would be minimal. However, golfers play at different skill levels and rates of play. Some golfers play a round of golf at a uniform pace and if they do not encounter delays as a result of preceding groups, can play at a uniform pace finishing the round in the prescribed time. Other golfers, due to higher handicaps as well as intervening occurrences such as shots into the rough or hazards, may take substantially longer periods of time to play a round of golf. This results in the player's entire group being required to play at a slower pace which will result in subsequent groups being held up. This inconsistent rate of play causes spacings between groups with spacings being either compressed or expanded with the result that on a crowded day, play often takes substantially longer than the prescribed or normal period of time.

Golf etiquette or courtesy dictates that slower groups should allow faster groups to play through, however this etiquette is not always observed. In an effort to maintain a consistent pace of play, many golf courses employ various means to speed up play. Some courses require that if a group does not finish the first nine of play within the prescribed time, the group is not allowed to play the second nine. Other courses employ golf rangers who are individuals that monitor the play on the course and encourage slower playing groups to increase their rate of play. While these methods are effective to some degree, they do not provide a totally acceptable solution to the problem of slow play on a golf course. The problem of slow play is often due to the failure of the individual player or group to monitor its progress which failure is generally the result of simply not having any specific reference against which to gauge the speed of play.

Accordingly, the present invention provides a device that provides a golfer a reference which indicates a location where the golfer should be on the golf course at a prescribed time with reference to a prescribed playing time. It should be appreciated that while the present invention is described with reference to an indicating device for use by golfers, the present invention will have applicability to many types of activities which require a participant to pass certain checkpoints or locations along a path of travel within a prescribed time. These other activities include automobile rallies, distance running and the like.

Briefly, in a preferred embodiment, the present invention provides a self-monitoring indicating device having a timing movement which moves indicia relative to a face at a prescribed rate. The face or dial graphically depicts the activity path. In the preferred embodiment, the movement rotates the hand of a clock or timing device around the face. The face graphically or pictorially depicts the layout of the golf course in a generally circular fashion with the arcuate length of each golf hole being proportional to the prescribed playing time for the hole. Thus, by referring to the device, the golfer can determine his or her location on the course in relation to a prescribed playing location. The golfer can then adjust his or her playing rate accordingly with the result that all golfers can better maintain prescribed playing times and delays will be minimized. The device is preferably enclosed in a weather-resistant, impact-resistant casing which may be detachably secured to a golf cart such as on the steering column or may be carried by a golfer in the event the golfer is walking rather than riding a cart. The device also includes an auxiliary timer which times a pre-set period, as for example five minutes, and provides a visual or audible alarm which gives an indication when the prescribed period of time is expired. This will allow the participants to time an activity such as looking for a lost ball.

In an alternate embodiment of the invention, the device is arranged having a linear rather than a radial representation of the activity. The golf holes are laid out linearly and relative motion is imparted between the face of the device and the pointer to provide an indication of location where the golfer should be within a prescribed time. In still another embodiment, the device has a digital display indication of the golfer's prescribed location.

The above and other objects and advantages of the present invention will be more apparent from the following description, claims and drawings in which:

Figure 1:
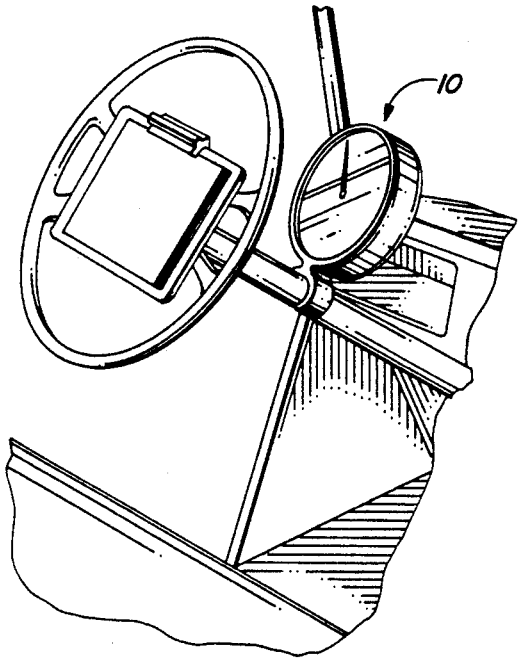
FIG. 1 is a perspective view showing the timing device of the present invention mounted on a golf cart vehicle.
Figure 2:
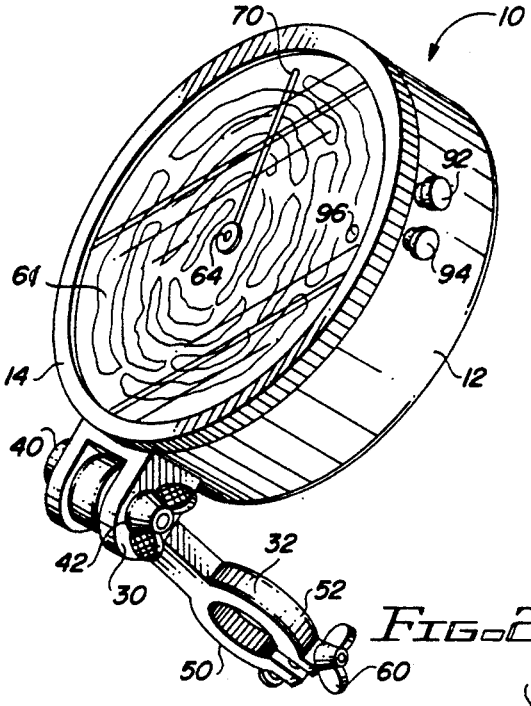
FIG. 2 is a front perspective view of the timing device of the present invention.
Figure 3:
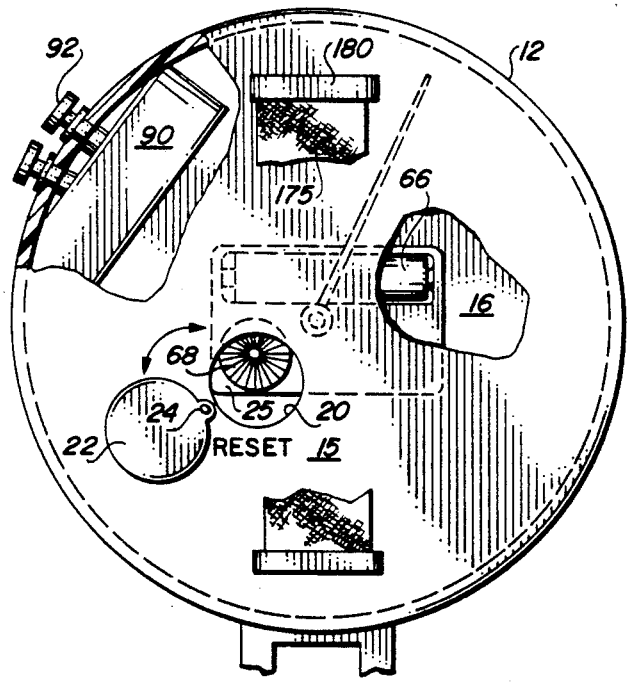
FIG. 3 is a rear perspective view of the timing device of the present invention.

Turning to the drawings, particularly FIGS. 1 to 4, the device of the present invention is generally designated by the numeral 10. The device has a housing 12 which defines a generally circular rim 14. The housing may be of any suitable shape and is shown as generally cylindrical having a rear wall 15 defining an interior compartment 16. The housing is preferably fabricated by molding or other conventional techniques from a suitably strong, impact-resistant plastic, such as polyvinyl chloride with a UV inhibitor. Access to the compartment 16 is provided through aperture 20 located in the rear portion of the housing. A cover plate 22 is pivotally attached to the rear of the housing by a rivet 24 or similar member. The cover plate 22 may be rotated to an open position as shown in FIG. 3. As will be more fully explained hereafter, the housing compartment 16 receives a clock movement 25.

The device may be manually carried by the user, however, preferably the device will be mounted on a golf cart vehicle. To facilitate mounting on a golf cart vehicle, mounting bracket 30 is provided. The mounting bracket 30 adjustably receives clamp 32. The clamp 32 is adjustable with respect to the device by means of a fastener 40 which has a threaded body and a wing nut. The fastener extends through an aperture 42 in the bracket and through an aligned bore in the clamp. The lower end of the clamp 37 has spaced-apart legs 52 and 54. The clamp 32 may be secured in a suitable position on the golf cart such as about the steering column. A mechanical fastener 60 extends between legs 52 and 54 to tighten them in place about the steering column or other mounting location. The steering column location shown in FIG. 1 is particularly ideal since it places the device in a position from which it may be viewed by both the driver and passenger in the cart as well as other players while not interfering with the operation of the golf cart.

Figure 4:
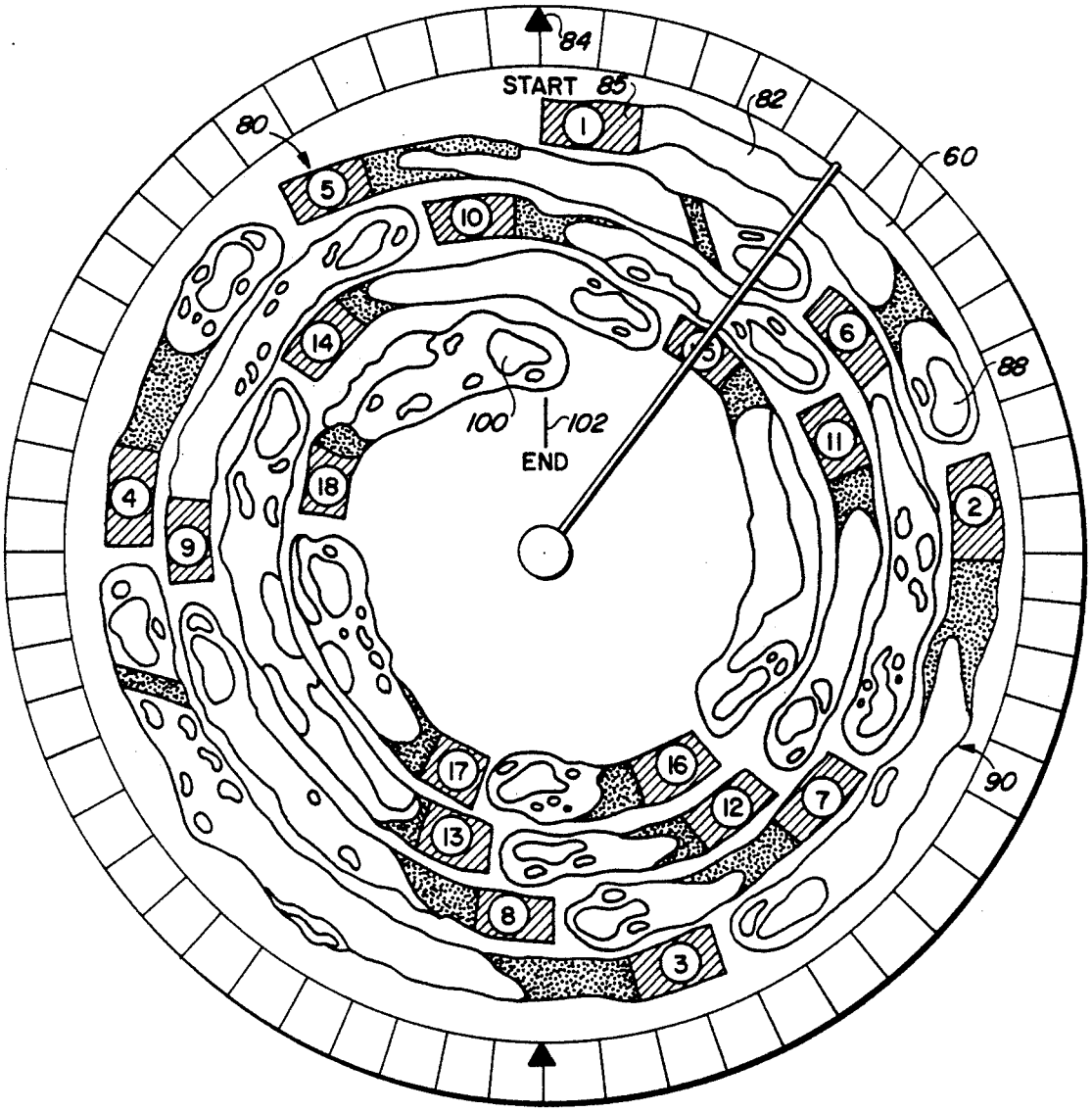
FIG. 4 is an enlarged, detail view showing a representative dial face for the timing device on which the holes of a golf course are concentrically arranged.

The device is provided with a generally planar face 60 which is best shown in FIG. 4. It will be apparent that the device may be any convenient shape. The face 60 defines a centrally located aperture through which the shaft 64 of the clock movement 25 extends. The clock movement may be any conventional type powered by a battery 66. A re-set dial 68 is positioned on the rear of the movement and is accessible through access opening 20 in the rear of the housing. The shaft carries a sweep pointer 70 which moves at a predetermined rate. Typically, in the case of a timer for golfers, the pointer completes one revolution in one hour. Thus, a conventional clock movement can be easily modified for inclusion in the device by simply removing the hour hand. The remaining minute hand will operate as the pointer 70. The re-set dial 68 allows the pointer and indicia 70 to be positioned at the twelve o'clock position at the beginning of a timing sequence.

As indicated above, the purpose of the invention is to provide the user of an indication of where the user should be along an activity pathway after predetermined elapsed time. To this end, as seen in FIG. 4, the face 60 is provided with an activity path 80 which, in the case of timer for use for golfers, consists of a graphic representation of the golf course. In this case, the various golf holes "1" through "18" are presented as segments of the activity path. For example, golf hole number "1" is represented by an arcuate segment 82 extending from approximately the twelve o'clock starting position 84 to a position which would correspond to approximately 2:30 on the normal clock face. The activity path 82 has an initial segment 85 which is representative of the tee area on the first hole and carries designation 85 indicating that it is the first hole. The increment 82 extends along a path 86 which is representative of the length of the fairway of a particular golf hole and terminates at a green area indicated as 88. Successive activity path 90 is representative of the second hole of the golf course and subsequent activity paths are provided for all eighteen holes of the particular course. The golf holes are arranged in a concentric or spiral fashion beginning at tee 85 of the first hole, arranged at the twelve o'clock position and ending with the green area 100 of the eighteenth hole corresponding with the ending time 102. It will be apparent that the graphics on the face of the indicator will vary depending on the length and lay out of the specific golf course. As shown, the graphics are representative of the Tournament of Players Club course of Scottsdale, Ariz. It will also be apparent that the length of the individual increments or holes are selected in accordance with the predetermined time required for playing the particular hole. Since the golf course is laid out on the face in a circular configuration, it is not possible to represent in accurate detail every feature of the golf course. For example, the arrangement would not permit accurate representation of a hole which is a dog-leg left, but the pictorial representation does nevertheless give the golfer a general idea of the topography of each hole and such features as water hazards and sand traps can be illustrated to further assist the golfer during the game. Other information relative to the course such as hole length, local rules and the like may also be provided on the face.

In the embodiment shown, the clock movement rotates around the dial once each hour. Thus, from the starting point 84 to completion of the golf round, four rotations of the dial will occur in four hours. Thus, by simple inspection, a golf player can determine the approximate location at which the golfer should be on the golf course at any time. For example, as shown, the pointer is at a location approximately 30° displaced from the starting point. Thus, if the golfer has been playing for approximately an hour and ten minutes, the golfer should be completing the fifth hole. If the golfer is at approximately this location, the golfer will know that he or she is playing at an acceptable rate of play. If the golfer, for example, is only beginning the fifth hole, the golfer will know that play must be speeded up to maintain an acceptable rate of play. Although the pointer also indicates a position on holes 1, 10 and 15, the golfer will appreciate which hole is the appropriate position on the course from a knowledge of the starting time and the knowledge that ordinarily a round of golf requires approximately four hours to complete.

In addition, to the timing device which provides the golfer an indication of acceptable progress along the course, the device may, as an option, include an auxiliary timer which may be activated to provide the golfer an indication of a period of time for searching for a golf ball. The rules of golf provide that a player has five minutes to search for a ball before it must be declared lost. Thus, in the event the golfer should hit a shot which lands in the "rough", the auxiliary timer may be started and an audible or visual alarm will be emitted at the end of the prescribed period of time, such as five minutes. Thus, as best seen in FIG. 2, the housing 12 contains a conventional timing device 90 which is secured or attached to an interior wall of the housing. The timer may be of any conventional type clock movement which is known. The timer has a start button 92 which extends through an aperture in the housing and a re-set button 94 which also extends through an aperture in the housing. Thus, this timer feature allows a player to initiate the timing cycle by pushing the start button 92. An audible or visual alarm is emitted at the end of the prescribed period which notifies the player that the allotted time period has elapsed and the ball must be declared lost. As shown, a light 96 is provided on the face of the dial which will illuminate after the set time has expired. This reminder will have the benefit of maintaining the rate of play as players will not then unknowingly continue to search for a lost ball after the allotted legal time has passed. The timer is simply re-set by pushing the re-set button 94.

As indicated above, the graphic display of the activity path, such as a golf course, may be artistic or symbolistic. A truly artistic representation would represent the holes in a reasonably correct aerial view taking into consideration the generally circular or spiral layout of the golf course on the face of the device. In such a case, the length of fairways, size of the greens, location and size of the hazards, will be reasonably accurate and will assist the golfer in playing the game. As an alternative, purely symbolic designs representing tee boxes, fairways and the like could also be shown again with the arcuate length of each hole being selected in relation to the time which should normally be required to play the hole. The golf course designer or the professional staff at the golf course will prescribe the playing time for each hole.

The timer 25 may be set for different time periods or the graphics represented so that prescribed playing time for an eighteen hole round will be more or less than four hours taking into account the difficulty of the course.

Figure 7:
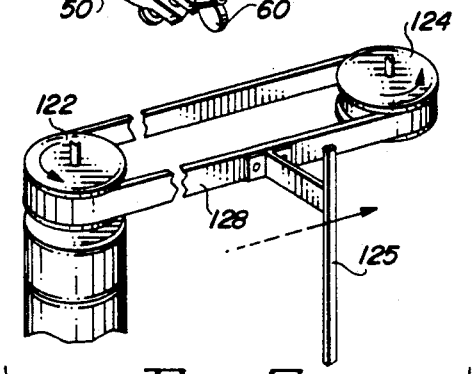
FIG. 7 is a perspective view of the drive mechanism of FIG. 6.
Figure 6:
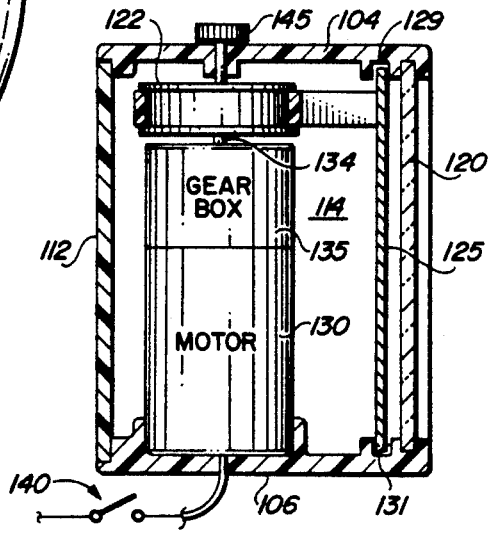
FIG. 6 is a sectional view taken along line 6—6 of FIG. 5.
Figure 5:
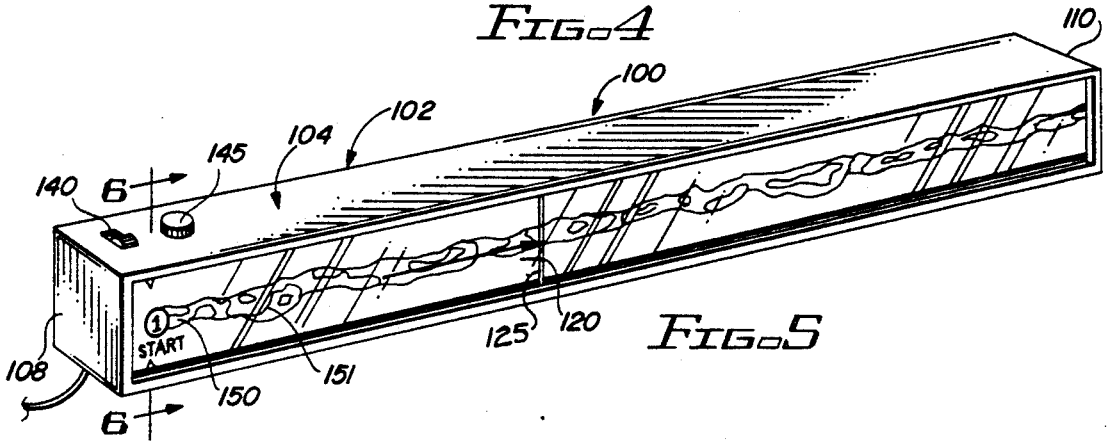
FIG. 5 illustrates another embodiment of the present invention in which the golf course is laid out in a linear arrangement.

The timer device as described above is arranged with a fixed face and a pointer or indicia that moves around or past the activity path representations on the dial. In an alternate embodiment of the device, the device may be arranged in a linear fashion instead of a radial movement as described above. Referring to FIGS. 5, 6 and 7, an alternate embodiment of the present invention is shown which is generally designated by the numeral 100. In this version, the housing 102 is generally elongate having top wall 104, bottom wall 106, opposite end walls 108 and 110 and rear wall 112 which define the internal compartment housing 114. The housing has a front panel 120 which is inwardly recessed from the edges of top wall, bottom wall and end walls. The panel 120 is a transparent or translucent material such as Lucite.

The interior of compartment 114 receives pulley 122 rotatably mounted adjacent end wall 108. A similar pulley 124 is rotatably mounted adjacent end wall 110. A pointer 125 is carried on endless band 128 and traverses along the rear of the panel 120 in guide slots 129 and 131. Electric motor 130 is in driving engagement with pulley 122. Motor 130 has a shaft 134 which rotates at a fixed speed and which drives gear box 135 which, in turn, rotates pulley in counterclockwise direction at a predetermined rotational speed. Motor 130 is electrically operated from a battery or other d.c. source or may be a mechanical device which is periodically wound by the user. The motor rotates output shaft 130 at a predetermined fixed speed which timing cycle is initiated by the depression of a switch 140. The device is re-set by rotating knob 145 to bring the pointer 125 to the "start" location.

The golf course or other activity path is represented on the face of the panel 120. Panel 120 carries a graphic representation of the activity such as a linear layout of the golf course. The design may be artistic or symbolistic as discussed above. In most cases, as in the case of a golf timer, the course will be represented as a reasonably correct plan view. A principal advantage of the linear arrangement is that the individual golf holes may be more accurately represented with, for example, dog-legs both left and right, can be shown. The design constraints of the radial embodiment shown in FIGS. 1 and 4 are not imposed with a linear graphic.

Each component of the representation, such as a golf hole 150, 151, etc., will have an overall length selected in accordance with an established time period taking into account the rotative speed of the driven pulley. Thus, once the switch 140 is depressed, the motor 130 will begin to rotate which will cause the endless belt 128 which causes the pointer 125 to move. At the beginning of a golf game, the tee box of the first hole is aligned with pointer 125. As the game progresses, the belt and pointer will advance and by simple visual inspection at any moment, the golfer can determine the location at which the golfer should be in order to complete the round of golf in a prescribed period of time. As an alternative, the pointer 125 can be fixed and the panel 120 can be flexible material which is wound between the opposite pulleys at a fixed rate.

An auxiliary event timer may also be incorporated in the housing as an optional accessory. Thus, a timer such as timer 90 described with reference to FIGS. 1 to 4, may be enclosed in the housing and may be set for a prescribed period of time, such as five minutes, which would allow the golfer to search for a lost ball only as long as the rules of golf permit. At the conclusion of the round, the device is turned off at switch 140 and the pointer re-set to the starting point by rotating knob 145.

As indicated above, the device is preferably mounted on a golf cart and will provide a continual and subtle reminder to the participants to maintain a prescribed rate of play. Alternatively, the timer may be carried by the golfer, in which event a strap 175, as shown in FIG. 3, may be secured to the golfer's bag and through the loops 180 provided for this purpose at the rear of the housing. The timer device may be a mechanical device, battery operated or electronic device.

Figure 8:
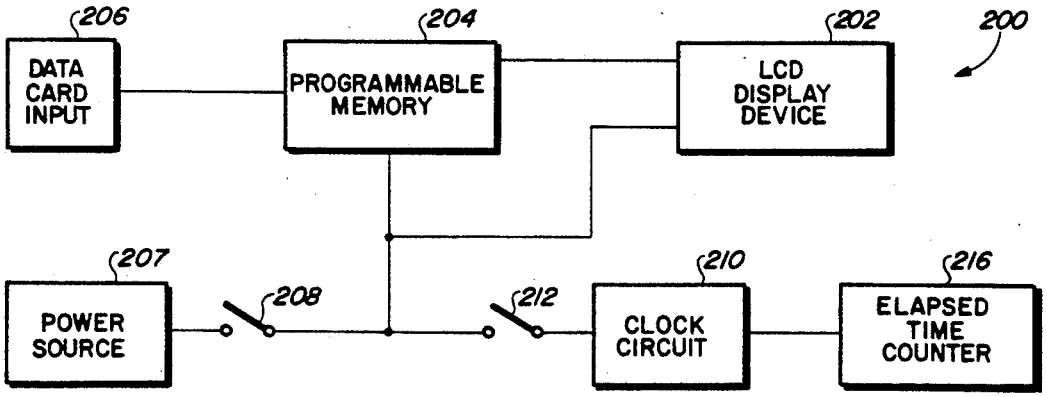
FIG. 8 is a schematic diagram of still another embodiment of the invention.

FIG. 8 illustrates still another embodiment of the present invention which is generally designated by the numeral 200 having a display device in the form of a liquid crystal display (LCD). The display device is designated by the numeral 202 and is operatively connected to programmable memory 204 which may be selectively programmed by data card input device 206. The data card input device will program memory 204, as for example, with information concerning the lay out of a particular golf course. A power source 206 is connected to the memory 204 across switch 208. The power source is also connected to clock circuit 210 across switch 212. The clock circuit is connected to an elapsed time counter 216 which generates a signal based on elapsed time to energize a particular area of display 202. Upon closing switch 208, the display is energized. Switch 212 is closed to initiate the counting cycle. Thus, once the counting cycle has begun, closing switch 212 will result in the display device being energized to display information relative to the prescribed progress location on the golf course. For example, after approximately two hours of play, the display device would, for example, indicate a reading such as "10th tee", indicating that the golfer should be at a location, approximately the tenth tee at this time. The display device processes the digital signal received from elapsed time counter 16 to light a particular area of the LCD.

Figure 9:
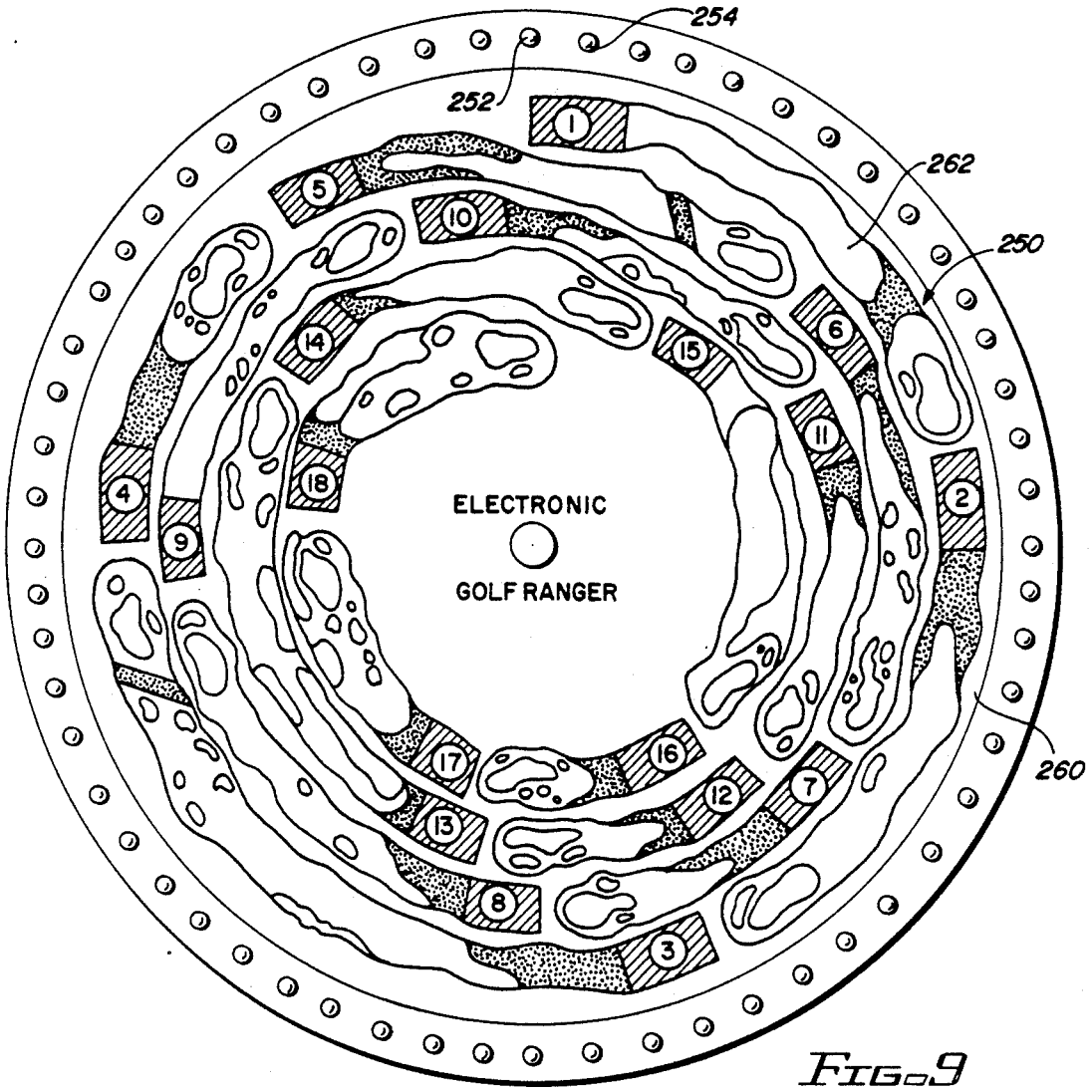
FIG. 9 shows an electronic version having an LED display.

In another embodiment of the present invention, the LCD may be replaced with an LED such as shown in FIG. 9. The LED display 250 is arranged having a circular arrangement of closely spaced individual LED's 252, 254, etc. An overlay 260 is placed on the face of the LED with a representation of activity paths 262 such as the holes of a golf course arranged as concentric circles or in a spiral fashion with respect to the center of the LED display. In the case of the lay out of a golf course, the individual holes have a predetermined length in relation to the timing cycle. For example, if the clock circuit controls the elapsed time counter LED so that the LED display operates at a rate of one revolution per hour, then the display would be arranged similar to the display shown in FIG. 4 with, as an example, a golf hole that would normally take ten minutes to play would have an arc length of 60°.

Again, the display device processes the digital signal received from the elapsed time counter and will light a particular LED corresponding to the appropriate desired progress location on the course.

The advantage of the embodiments shown in FIGS. 8 and 9 is that they are electronic devices and may be made relatively small so that they may be easily carried by the golfer in a pocket or attached to a golf bag.

A principal object of the device is to provide a means by which all players on the golf course will have a continual and common reference device with respect to the pace or rate of play. As indicated above, golfers who play slow hold up all players playing behind them causing considerable difficulty for golf course operators which can be a source of irritation to other players. Unfortunately, slow players often are unaware that they are playing slow, making the enforcement of timely rate of play difficult for golf course administrators.

Thus, the present invention provides a device which may be used by golfers and others to indicate to the user an indication of prescribed progress location along a golf course or other activity path. It will be apparent to those skilled in the art that various changes, modifications can be made to the various embodiments disclosed herein. To the extent these various changes and modifications do not depart from the spirit and scope of the appended claims, they are intended to be encompassed therein.

I claim:

1. A device for providing a golfer a continuous indication of a prescribed location on a golf course after a fixed, predetermined elapsed period of time after beginning play, said device comprising:

(a) a housing;

(b) a face associated with said housing having a graphic representation of a golf course thereon, said graphic representation being arranged in a generally concentric arrangement about a center point with each golf hole having predetermined length representative of a standard time period which is required to play the hole;

(c) a pointer rotatable in clock-like movement about said center point;

(d) a clock movement operatively connected to said pointer to move said pointer a predetermined rate whereby said pointer provides an indication of said prescribed progress to enable a golfer to determine if the speed of play is proper.

2. The device of claim 1 further including mounting means associated with said housing.

3. The device of claim 1 further including selectively actuable auxiliary timer means which provides a perceptible audible or visible alarm.

4. The device of claim 1 wherein said clock movement is battery operated and is provided with re-set means to re-start the timing cycle.

* * * * *